United States Patent [19]

Heinonen

[11] Patent Number: 4,854,394

[45] Date of Patent: Aug. 8, 1989

[54] ARRANGEMENT FOR SUPPORTING OF A SHANK OF A DRILLING MACHINE

[75] Inventor: Jarmo Heinonen, Tampere, Finland

[73] Assignee: Oy Tampella AB, Tampere, Finland

[21] Appl. No.: 43,162

[22] Filed: Apr. 27, 1987

[30] Foreign Application Priority Data

May 9, 1986 [FI] Finland ..... 861940

[51] Int. Cl.[4] ..... E21B 6/00

[52] U.S. Cl. ..... 173/105; 173/171

[58] Field of Search ..... 173/104, 105, 31, 38, 173/162.1, 171

[56] References Cited

U.S. PATENT DOCUMENTS 1,918,065 7/1933 Terry ..... 173/162.1
3,620,312 11/1971 Krasnoff ..... 173/105
4,161,990 7/1979 Forsberg et al. ..... 173/105

FOREIGN PATENT DOCUMENTS 1217307 5/1966 Fed. Rep. of Germany .
0899902 1/1982 U.S.S.R. ..... 173/104

*Primary Examiner*—Frank T. Yost
*Assistant Examiner*—James L. Wolfe
*Attorney, Agent, or Firm*—Ladas & Parry

[57] ABSTRACT

An arrangement for mounting and supporting of a shank of a drilling machine comprising a body supported by a carriage, a percussion piston mounted in the body, and supporting housing positioned at a front side of the body, and a shank piece mounted in the supporting housing as an axial extension of the percussion piston. In order to reduce the strains exerted on tie rods of the body of the drilling machine, the supporting housing of the shank is supported at least partly by the carriage separately from a support between the body and the carriage so that the sideward forces acting on the shank are received directly by the carriage through the supporting housing.

10 Claims, 2 Drawing Sheets

Figure 1:
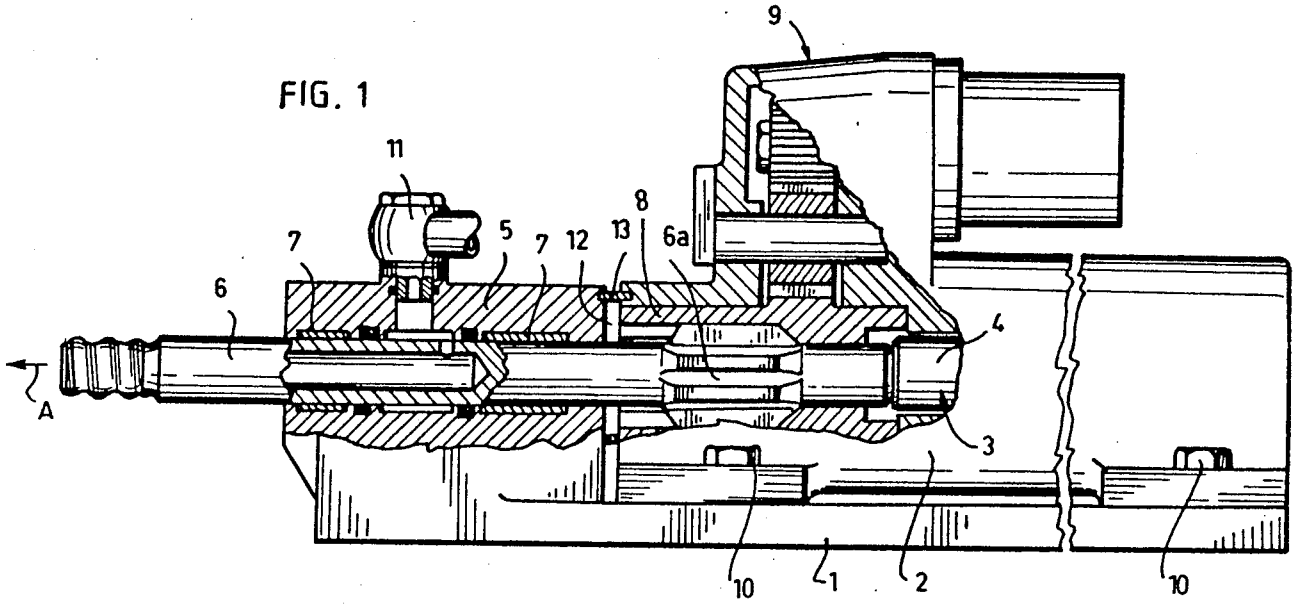

FIG. 2
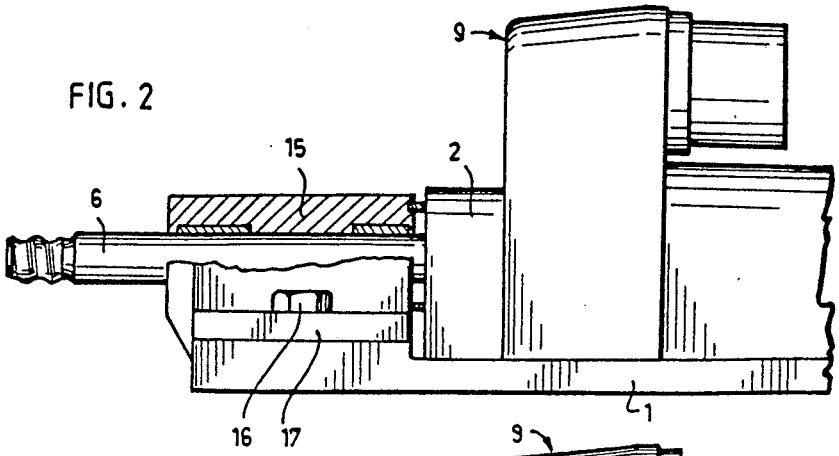
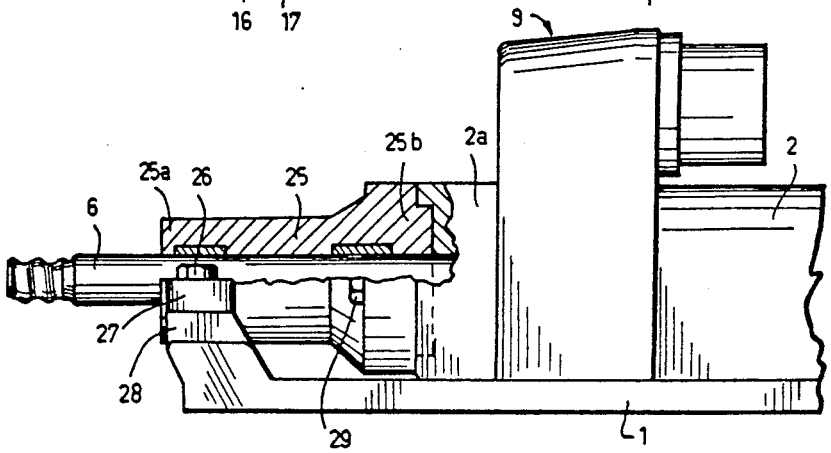
FIG. 3

ARRANGEMENT FOR SUPPORTING OF A SHANK OF A DRILLING MACHINE

This invention relates to an arrangement for mounting and supporting of a shank of a drilling machine comprising

- a body supported by a carriage,
- a percussion means mounted in the body,
- a supporting housing positioned at a front side of the body, and
- a shank mounted rotatably and axially slideably in the supporting housing as an axial extension of the percussion means.

The definition "front" as used herein refers to the drilling direction of the drilling machine and the definition "rear" to the opposite direction.

In conventional hydraulic percussion drilling machines a percussion means mounted in the body is intended to direct successive axial percussions on a shank which, in turn, is intended to be fastened to a drill rod. The shank is mounted rotatably and axially slideably in a supporting housing which is supported by and fastened directly to the body of the drilling machine. The supporting housing may be formed in the front cover of the drilling machine, in a shank flange or in a side flushing housing through which flushing liquid is supplied to the drill rod. The body of the drilling machine is supported by and fastened to a feeding carriage on which the drilling machine is displaceable along a feeding beam of the drilling equipment.

However, known drilling machines in which the supporting housing of the shank is suppoted by the body of the drilling machine have certain major disadvantages. Sideward forces exerted on the shank strain the tie rods of the drilling machine by means of which tie rods separate body elements are assembled into one integral body and which tie rods may damage the percussion means if they are opened or broken. The sideward forces of the shank also strain and wear the connecting surfaces of the drilling machine, so that the tightening torque of the fastening screws is reduced. There is also a risk that the supporting housing which is supported by the body on one side only will get into a slanting position under the influence of the sideward forces exerted on the shank, so that the piston of the percussion means strikes against a slanted surface of the shank, causing damage in the percussion means and the cogging of the rotation machinery.

The object of the invention is to provide an arrangement for supporting and mounting of the shank, which arrangement avoids the above disadvantages and enables the supporting housing of the shank to be supported in an appropriate way. This object is achieved by means of an arrangement according to the invention which is characterized in that the supporting housing of the shank is at least partly supported directly by the carriage separately from a support between the body and the carriage.

The invention is based on the idea that the sideward forces acting on the shank are totally or partly received directly by the carriage, so that they are not transmitted through the body. Due to this the strains exerted on the body are correspondingly reduced or totally avoided. In this way the tie rods of the drilling machine are released from the strains caused by the sideward forces acting on the shank as well as from the strains caused by forces applied for releasing a stuck drill rod. As a result of this the risk that the tie rods are opened or broken is eliminated and the wear of the connecting surfaces of the drilling machine is avoided. Because the supporting housing of the shank is supported directly by the carriage, the supporting housing will be supported both at the front and at the rear portion thereof or, if required, over the entire axial length thereof. In this way it can be ensured that the accurate direction of the shank with respect to the percussion means is maintained.

The invention will be described in more detail in the following with reference to the attached drawings, wherein FIG. 1 is a partial axial section in a side view of a drilling machine provided with a supporting arrangement, according to a first embodiment of the invention, and FIGS. 2 and 3 illustrate supporting arrangements according to two other embodiments of the invention similarly as in FIG. 1.

The drilling machine shown in FIG. 1 of the drawings comprises a carriage 1 which is intended to be mounted on a feeding beam of a drilling equipment in a known manner. The carriage supports a body 2 in which a percussion means 3 is mounted. The percussion means comprises an axially displaceable percussion piston 4. A supporting housing 5 for a shank 6 is provided in front of the body as seen in the drilling direction, which shank is mounted rotatably and axially slideably in the supporting housing by means of bearings 7. The shank is positioned on an axial extension of the percussion piston, and a rear portion **6*a* of the shank extends into the body. The shank is in a known manner in engagement with a rotation bushing 8 mounted in the body and rotated by a rotation machinery 9. Tie bolts by means of which the body is fastened to the carriage are indicated by the reference numeral 10**.

The supporting housing is in this embodiment formed in a side flushing housing which is provided with a connection 11 for supplying of a flushing liquid.

According to the invention the supporting housing 5 is made integral with the carriage 1 so that in this embodiment the supporting housing and the carriage form one unity. The body is fastened to the carriage at such a point that a small gap 12 is formed between the supporting housing and the body. This gap is sealed by means of a seal 13.

It is noted that the sideward forces acting on the shank as well as the forces required for releasing a stuck drill rod are transmitted directly from the suppoting housing to the carriage, so that these forces do not at all strain the body and the tie rods thereof. Further, the mounting of the shank is very steady, because the supporting housing is stationarily attached to the carriage over the whole length thereof. This ensures that the accurate direction of the shank with respect to the percussion piston is maintained. No connecting surfaces liable to wear need to be provided between the supporting housing and the body, either.

The shank supporting arrangement shown in FIG. 2 differs from that shown in FIG. 1 mainly only with respect to a supporting housing 15 which is separate from the carriage 1. The supporting housing is provided with a flange 17 which is attached stationarily to the carriage by means of bolts 16.

Also in this embodiment the sideward and the releasing forces acting on the shank are altogether received directly by the carriage, so that they do not strain the body and its tie rods. The supporting housing is herein shown without a side flushing housing. The supporting housing is supported by the carriage over the whole length thereof.

The shank supporting arrangement shown in FIG. 3 differs from that shown in FIG. 2 mainly only with respect to a separate supporting housing 25 which is supported by the carriage 1 only at a point portion 25*a* thereof. For this purpose the supporting housing is provided with a flange 27 which is attached by means of bolts 26 to a support 28 provided in the carriage. A rear portion 25*b* of the supporting housing is supported by the front portion 2*a* of the body 2 in the axial and the radial direction and is attached to the body stationarily by means of bolts 29. In this embodiment, too, a major part of the sideward and releasing forces acting on the shank can be transmitted through the support 28 at the front portion directly to the carriage so that the forces do not act on the body in spite of the fact that the rear portion of the supporting housing is supported by the body. Since the supporting housing is supported by the carriage at the front portion thereof and by the body at the rear portion, the fastening of the supporting housing is very steady, so that the shank maintains reliably its axial direction with respect to the percussion piston.

The drawings and the description related thereto are only intended to illustrate the idea of the invention. In its details the arrangement according to the invention may vary within the scope of the claims.

I claim:

1. An apparatus for mounting and supporting shank of a drilling machine comprising:

a body;

a carriage adjacent to the body;

a first fastening means attaching the body rigidly to the carriage;

a percussion means mounted in the body; and a supporting housing portioned by a front portion of the body, wherein the shank, rotatable and axially slidable in the supporting housing, axially extends from the percussion means so as to be axially supported by the supporting housing, and wherein the shank is independently supported by the support housing separate from the support of the body by the first fastening means.

2. An apparatus according to claim 1, wherein the supporting housing is integral with the carriage.

3. An apparatus according to claim 2, wherein the supporting housing is axially separated from the body.

4. An apparatus according to claim to 3, wherein a seal extends between the front portion of the body and a rear portion of the supporting housing.

5. An apparatus according to claim 2, wherein the supporting housing is formed by a side flushing housing.

6. An apparatus according to claim 2, wherein the shank piece projects from a rear portion of the supporting housing and extends into the body so as to be contacted by the percussion means.

7. An apparatus according to claim 1, wherein the supporting housing is fastened to the carriage by a second fastening means.

8. An apparatus according to claim 7, wherein the supporting housing is axially separated from the body.

9. An apparatus according to claim 8, wherein a seal extends between the front portion of the body and a rear portion of the supporting housing.

10. An apparatus according to claim 1, wherein the supporting housing is attached to the carriage by a second fastening means, and wherein a rear portion of the supporting housing is attached to the front portion of the body by a third fastening means positioned between the first and second fastening means.

* * * * *